United States Patent [19]

Chute et al.

[11] 4,346,870

[45] Aug. 31, 1982

[54] THERMAL BARRIER FOR POPPET VALVE

[75] Inventors: Richard Chute, Birmingham; Jay M. Larson, Marshall; Theodore N. Tunnecliffe, Battle Creek; Roger P. Worthen, Farmington Hills, all of Mich.

[73] Assignee: Eaton Corporation, Cleveland, Ohio

[21] Appl. No.: 210,692

[22] Filed: Nov. 26, 1980

[51] Int. Cl.[3] ..... F01L 3/00

[52] U.S. Cl. ..... 251/356; 123/188 AA

[58] Field of Search ..... 123/188 AA; 251/356, 251/323; 29/157.1 R, 157.1 A, 156.7 C, 156.7 R; 137/334, 340

[56] References Cited

U.S. PATENT DOCUMENTS

| | | | |
|---|---|---|---|
| 1,449,876 | 3/1923 | Williams | 123/188 S |
| 1,601,274 | 9/1926 | Warrington | 123/65 VC |
| 1,726,353 | 8/1929 | Jardine | 29/156.7 R |
| 1,823,452 | 9/1931 | Heron | 123/188 AA |
| 1,868,138 | 7/1932 | Fisk | 123/188 A |
| 1,984,728 | 12/1934 | Colwell | 29/156.7 C |
| 2,058,741 | 10/1936 | Taylor | 29/156.5 R |
| 2,183,254 | 12/1939 | Charlton | 123/188 AA |
| 2,369,063 | 2/1945 | McDill | 123/188 AA |
| 2,450,803 | 10/1948 | Johnson | 123/188 AA |
| 2,513,939 | 7/1950 | Hoern | 123/188 AA |
| 2,840,427 | 10/1948 | Dolza | 307/288 |
| 2,947,582 | 8/1960 | Laagewaard | 92/176 |
| 3,473,444 | 10/1969 | Leffers | 92/176 |
| 3,701,342 | 10/1972 | Owsley et al. | 123/188 A |
| 4,300,492 | 11/1981 | Bart | 123/188 AA |

FOREIGN PATENT DOCUMENTS

| | | | |
|---|---|---|---|
| 2333890 | 2/1975 | Fed. Rep. of Germany | 123/188 AA |

*Primary Examiner*—A. Michael Chambers

*Attorney, Agent, or Firm*—C. H. Grace; F. M. Sajovec

[57] ABSTRACT

Thermal barriers (10, 26) fixed to mushroomed heads (12, 28) of poppet valves intended for diesel engines are disclosed. Thermal barrier (10) includes an insulating material (18) bonded to a face portion (12*a*) of mushroom head (12), a sheet metal shield (20) covering the insulating material, and a flange (22) clamped over the outer periphery of the shield and welded to the valve head. Thermal barrier (26) includes an insulating material encapsulated in a sheet metal sheath defining an evacuated chamber (32) which covers a face portion (28*a*) of the mushroom head (28), a sheet metal shield (30), and a flange portion (28*b*) integrally formed with the mushroom head and spun over the shield during final assembly to clamp the shield over the encapsulated insulating material. The flanges in both embodiments make line contact with the shield to minimize heat flow from the shields to the flanges and hence to the valve head.

13 Claims, 2 Drawing Figures

Fig. 1.
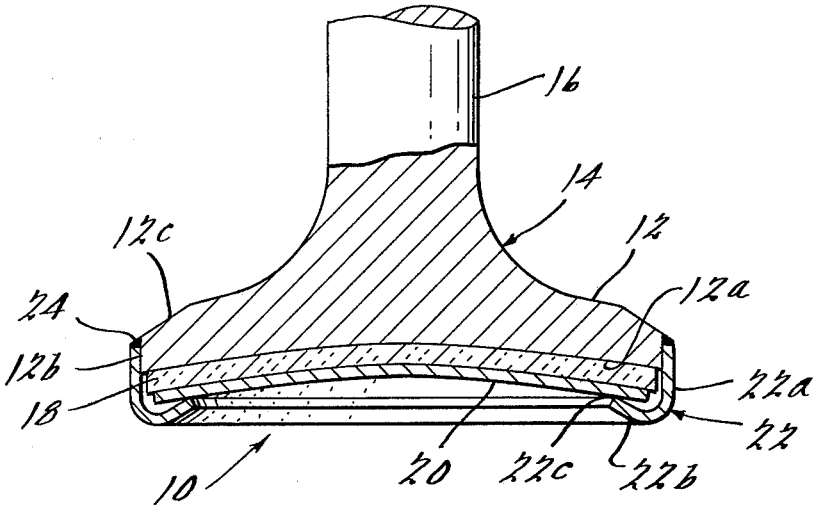
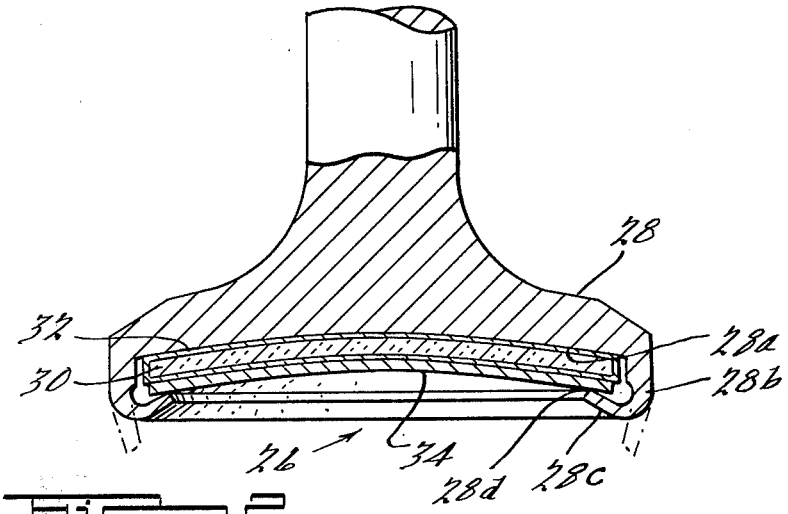
Fig. 2.

THERMAL BARRIER FOR POPPET VALVE

CROSS-REFERENCE TO RELATED APPLICATIONS

This application is related to U.S. patent application Ser. No. 104,928 filed Dec. 18, 1979, now U.S. Pat. No. 4,300,492, which was a continuation of application Ser. No. 908,330, filed May 5, 1978 and now abandoned; U.S. patent application Ser. No. 189,472, filed Sept. 22, 1980; U.S. patent application Ser. No. 193,679, filed Oct. 3, 1980. These applications are assigned to the assignee of this application.

BACKGROUND OF THE INVENTION

1. Field of the Invention

This invention relates to a thermal barrier valve and more specifically to a cover and insulator for a thermal barrier poppet valve used in a combustion chamber of a piston engine.

2. Description of the Prior Art

Covers or thermal barriers for protecting poppet valves in piston engine combustion chambers are well-known. For many years such covers or barriers have been proposed for the purpose of reducing heat corrosion and preventing weakening of the valve head, to improve or enhance combustion, to reduce heat conduction through the valve head, etc. These and other purposes are provided by the poppet valve thermal barriers disclosed in the above mentioned applications. Therein, the thermal barriers include a one-piece, cup-shaped, sheet metal cap or cover having a shield portion spaced from the valve face and integrally formed with a cylindrical skirt portion welded to the valve head to define an evacuated chamber. The evacuated space in the chamber is an excellent conductive heat flow barrier. The chamber is preferably filled with an insulating material to reduce radiation heat flow across the evacuated chamber and to support the shield portion. The skirt portion, which is conductively connected to the relatively hot shield portion and to the relatively cool valve head, has a temperature gradient over its length between the shield portion and valve head or weld. This gradient causes the skirt to expand in a bellmouth fashion and thereby relieve or reduce destructive stresses in the shield and skirt due to thermal expansion of the shield.

Manufacture of the above thermal barrier can be rather time-consuming to ensure a high vacuum in the chamber. Further, since the skirt portion is conductively connected to the shield portion and the valve head, heat flow to the valve head via the skirt portion can circumvent much of the heat barrier properties of the evacuated chamber unless the metal thickness of the skirt is small.

SUMMARY OF THE INVENTION

An object of this invention is to provide a poppet valve with a reliable and relatively inexpensive thermal barrier.

Another object of this invention is to provide a poppet valve with a thermal barrier having a metal shield which is substantially more thermally insulated from the valve head than previous shields and which is relatively stress free.

According to a feature of the invention; a thermal barrier poppet valve includes a face portion; a thermal insulator substantially covering the face portion; a sheet metal shield covering the insulation; and a flange fixed to the valve head, overlapping the outer periphery of the shield and making line contact with the shield to hold the shield snugly against the insulator.

According to another feature of the invention the thermal insulator is encapsulated in an evacuated chamber.

According to another feature of the invention the flange is integrally formed with the valve head and rolled over the outer periphery of the shield.

BRIEF DESCRIPTION OF THE DRAWING

The invention is shown in the accompanying drawing in which:

FIG. 1 is an elevational view in partial section of a poppet valve with a thermal barrier of the instant invention; and FIG. 2 is an elevational view in partial section of a poppet valve with an alternative thermal barrier embodiment of the instant invention.

Certain terminology referring to the proposed environment, direction, and motion will be used in the following description. This terminology is for convenience and clarity in describing the invention and should not be considered limiting in the appended claims unless the claims are explicity so limited.

DETAILED DESCRIPTION OF THE DRAWING

Referring now to FIG. 1, therein is shown a thermal barrier 10 supported by a mushroom head 12 of a partially shown poppet valve 14. Valve 14 is intended for use as an exhaust valve or as an intake valve in an expansible chamber engine of the internal combustion type which cyclically compresses and combusts gaseous mixture, e.g., a piston engine of the diesel or Otto cycle type. Further, thermal barrier 10 may be used on a poppet valve having a fillet heat shield.

Valve 14 includes a partially shown stem 16 and the mushroom head 12 shown in section. The surface of head 12 includes a circular face portion **12*a*, a cylindrical wall portion 12*b*, and a frustoconical valve seat portion 12*c***. The circular face portion is preferably dished inward to define a concave surface; however, the surface can be flat or convex.

The thermal barrier includes an insulator formed of an insulating material 18 such as Zirconium Oxide bonded to the valve face, a sheet metal shield 20 covering the insulating material, and a circular flange member 22. Sheet metal shield 20 provides a protective cover for insulating materials needing protection and adds to the total insulating effect of the insulator. Flange 22 includes a cylindrical skirt portion **22*a*, which telescopes over cylindrical wall portion 12*b*, and a flange portion 22*b* bent over such that the inside angle defined by flange and skirt portion is less than ninety degrees and such that an edge 22*c* of the flange portion makes line contact with the outer periphery of the shield for applying a clamping force in the general direction of the axis of stem 16 which snugly holds the shield against the insulating material. The skirt portion is secured to the valve head by a weld 24**.

Referring now to FIG. 2, therein is shown a thermal barrier 26 covering a face portion **28*a* of a mushroom valve head 28. The head is formed with a cylindrical wall portion depicted by the phantom lines. During final assembly of the thermal barrier the cylindrical wall is bent or spun over to define a flange analogous to flange 22 in FIG. 1**.

Thermal barrier 26 includes an insulator formed of an insulating material 30 encapsulated in a sheet metal sheath defining an evacuated chamber 32, a shield 34, and the cylindrical wall which, when bent or spun over, makes defines a flange having a cylindrical skirt portion 28*b*, a flange portion 28*c*, and an edge 28*d* making line contact with the outer periphery of shield 34 for snugly holding the shield and insulator in place. As with the flange in FIG. 1, the inside angle defined by the flange and skirt portions is preferably less than ninety degrees.

In both thermal barrier embodiments disclosed herein, the skirt and flange portions furthest or distal from the valve head get hotter than the base of the skirt portion, since the skirt portion is conductively connected to the relatively cool valve head, whereby the skirt and flange portions will expand radially outward in progressively increasing amounts away from the valve head in bellmouth fashion. Bellmouth expansion of the skirt portion skews the skirt wall radially outward and tends to lift the flange edge off the shield. However, since the inside angle between the flange and skirt portions is less than ninety degrees, radial expansion of the flange will tend to force the edge of the flange toward the shield, thereby offsetting the liftoff tendency caused by the bellmouth expansion of the skirt portion. The liftoff tendency is also countered by thermal expansion of the shield and insulator in the direction of the valve stem axis. To further prevent the liftoff tendency, the flange may be prestressed against the shield during assembly of the thermal barrier, as is readily possible in the flange configuration of FIG. 1, or the wall thickness of the flange portion may be made thinner than the wall thickness of the skirt portion. This is readily accomplished by tapering walls down from a maximum thickness at the base of the skirt portion to a minimum thickness at the distal end of the flange portion. The change in wall thickness decreases the temperature gradient of the skirt portion wall and increases the temperature of the flange portion wall, relative to the skirt portion wall, particularly at the distal or radially intermost edge of the flange in contact with the shield. The decreased temperature gradient of the skirt portion wall decreases expansion or growth of the wall in the direction of the valve stem axis and also decreases the amount of bellmouth expansion of the wall; both of these expansions contribute to the liftoff tendency. The increased temperature of the intermost edge of the flange relative to the skirt portion increases expansion in these areas and therefore the tendency of the flange edge to move toward the shield.

The encapsulated insulator, which may be manufactured as a subcomponent of the thermal barrier, need merely be dropped into place during assembly of the thermal barrier on the valve head, thereby simplifying and expediting assembly of the thermal barrier on the valve head. Further, since the encapsulated insulator includes an evacuated chamber and an insulating material, it has all of the excellent conductive and radiation insulating properties of the evacuated chamber disclosed in the previously mentioned U.S. Pat. No. 4,300,492, which is incorporated herein by reference.

In the embodiments of FIGS. 1 and 2, the line contact between the shield and the flanges greatly reduces conductive heat flow from the shield to the flange and hence to the valve head. Further, to prevent stresses in the shields and insulators due to thermal expansion, the diameters of the shields and insulators in both embodiments are preferably slightly less than the inside diameters of the skirts or cylindrical walls defining the recesses that the shields and insulators are contained within.

Zirconium Oxide was mentioned as an example of one type of insulating material which may be used in the embodiment of FIG. 1. This material may also be used in the embodiment of FIG. 2. This material is a satisfactory insulator, is readily formed in any desired shape, and is an excellent reinforcement. Another readily shaped insulating material, known to be an excellent insulation and reinforcement, is Min-K manufactured by Johns-Mansville Corporation. A few of the many additional materials which may be used as insulators are, pluralities of shims, multiple layers of alumina paper, mica, felt metal, etc.

Two embodiments of the invention have been disclosed for illustrative purposes. Many variations and modifications of the disclosed embodiment are believed to be within the spirit of the invention. The following claims are intended to cover the inventive portions of the disclosed embodiments and variations and modifications believed to be within the spirit of the invention.

What is claimed is:

1. A thermal barrier for a poppet valve having a mushroom head defining a circular face portion normally exposed to combusting gases in a combustion chamber of an expansible chamber engine, the thermal barrier comprising:

an insulator substantially covering the face portion; and a flange member including a skirt portion fixed at one end of the valve head and bent over at the other end to define a flange portion clamping said insulator against the face portion, said skirt portion having a wall circumscribing the insulator and extending at said other end beyond the general plane of the outer periphery of the insulator and a flange portion bent over the outer periphery of the insulator and contacting only the outer end of means covering said insulator, said flange portion making an inside angle of less than ninety degrees with the wall of said skirt portion.

2. A thermal barrier for a poppet valve having a mushroom head defining a circular face portion normally exposed to combusting gases in a combustion chamber of an expansible chamber engine, the thermal barrier comprising:

an insulator substantially covering the face portion; and a flange member integrally formed with the head for clamping the insulator against the face portion, said member including a skirt portion having a wall circumscribing the insulator and extending beyond the general plane of the outer periphery of the insulator and a flange portion bent over the outer periphery of the insulator so that the edge of the skirt contacts only the outer end of the valve and makes an inside angle of less than ninety degrees with the wall of said skirt portion.

3. The thermal barrier of claims 1, or 2 wherein said flange portion makes line contact with said means.

4. The thermal barrier of claim 1, or 2 wherein said insulator includes:

a sheet metal sheath defining an evacuated chamber; and an insulating material encapsulated in said sheath and reinforcing the walls of said sheath.

5. The thermal barrier of claim 1, or 2 wherein said means includes:

a sheet metal shield interposed between said insulator and said flange.

6. In an insulated poppet valve of the type including a mushroom head having a surface defining a circular face portion normally exposed to combusting gases in a combustion chamber of an expansible chamber engine, the improvement comprising:

an insulator substantially covering the face portion;

a sheet metal shield covering said insulator; and a flange member conductively fixed to the valve head and a thin portion of said member extending over the outer periphery of the shield for snugly holding the said shield against said insulator, said portion of said flange member making only line contact with the outer periphery of said shield to form the only metal-to-metal contact between said shield and said head to thereby minimize conductive heat transfer from said shield to said flange member and hence to the valve head.

7. The poppet valve of claim 6, wherein said flange member portion includes:

a skirt portion defined by a wall extending outward from the valve head at an angle substantially at right angles with respect to the general plane of the valve face portion and a flange portion clamped over the outer periphery of said shield, said flange portion makes an inside angle of less than ninety degrees with the skirt wall of said skirt portion.

8. The poppet valve of claim 1 or 7 wherein said insulator includes:

a sheet metal sheath defining an evacuated chamber; and an insulating material encapsulated in said evacuated chamber and reinforcing the walls of said sheath.

9. In an insulated poppet valve of the type including a mushroom head having a surface defining a circular face portion normally exposed to combusting gases in a combustion chamber of an expansible chamber engine, the improvement comprising:

an insulator substantially covering the face portion;

a sheet metal shield covering said insulator; and a flange member integrally formed with the valve head having a thin portion extending over the outer periphery of the shield and contacting the outer surface of said shield for snugly clamping said shield against said insulator, said portion of said flange member making only line contact with the outer surface of said shield to form the only metal-to-metal contact between said shield and said head to thereby minimize conductive heat transfer from said shield to said flange member and hence to the valve head.

10. The poppet valve of claim 9, wherein said flange member portion includes;

a skirt portion defined by a wall extending outward from the valve head at an angle substantially at right angles with respect to the general plane of the valve face portion and a flange portion clamped over the outer periphery of said shield, said flange portion makes an inside angle of less than ninety degrees with the skirt wall of said skirt portion.

11. The poppet valve of claim 9, or 10, wherein said insulator includes:

a sheet metal sheath defining an evacuated chamber; and an insulating material encapsulated in said evacuated chamber and reinforcing the walls of said sheath.

12. A thermal barrier for a surface normally exposed to combustion gases in a combustion chamber of an engine, the barrier comprising:

a support;

an insulator covering the surface; and a flange member including a skirt portion fixed at one end to said support member and bent over at the other end to define a flange portion clamping said insulator in place, said skirt portion having a wall circumscribing the insulator and extending beyond the general plane of the outer periphery of the insulator, and said flange portion bent over the outer periphery of the insulator and contacting only the outer surface of a shield covering said insulator, said skirt flange portion making an inside angle of less than ninety degrees with the wall of said skirt portion.

13. The thermal barrier of claim 12, wherein said support is defined by a structure defining the surface.

* * * * *